US011383116B2

(12) United States Patent
Zhang et al.

(10) Patent No.: US 11,383,116 B2
(45) Date of Patent: Jul. 12, 2022

(54) FOAM MATERIAL FOR FIRE PREVENTION AND EXTINGUISHING AND A PREPARATION METHOD AND A USE THEREOF

(71) Applicant: ANHUI UNIVERSITY OF SCIENCE & TECHNOLOGY, Huainan (CN)

(72) Inventors: Leilin Zhang, Huainan (CN); Biming Shi, Huainan (CN); Meiqi Zhang, Huainan (CN); Zhen Zhong, Huainan (CN); Qianyi Yang, Huainan (CN); Jian Wei, Huainan (CN)

( * ) Notice: Subject to any disclaimer, the term of this patent is extended or adjusted under 35 U.S.C. 154(b) by 51 days.

(21) Appl. No.: 17/002,843

(22) Filed: Aug. 26, 2020

(65) Prior Publication Data

US 2021/0154511 A1 May 27, 2021

(30) Foreign Application Priority Data

Nov. 22, 2019 (CN) ..... 201911152736.X

(51) Int. Cl.
*A62D 1/02* (2006.01)
*A63C 5/02* (2006.01)
*A62C 5/02* (2006.01)

(52) U.S. Cl.
CPC ..... *A62D 1/0071* (2013.01); *A62C 5/02* (2013.01)

(58) Field of Classification Search
CPC ..... A62C 5/008; A62C 5/02; A62C 99/0036; A62D 1/00; A62D 1/0071; A62D 1/0035; A62D 1/0042; E21F 5/06
USPC ..... 252/2, 3, 8.05
See application file for complete search history.

(56) References Cited

U.S. PATENT DOCUMENTS 4,177,152 A * 12/1979 Sarrut ..... A62C 3/06 252/2
5,676,876 A * 10/1997 Winkler, III ..... A62D 1/0071 252/3
2017/0056698 A1* 3/2017 Pai ..... A62D 1/0042

FOREIGN PATENT DOCUMENTS

CN 103881282 A * 6/2014
CN 103964766 A * 8/2014
CN 104906741 A * 9/2015
CN 104927550 A * 9/2015
CN 106730567 A * 5/2017
CN 107349553 A * 11/2017
CN 110256033 A * 9/2019
CN 110368633 A * 10/2019
CN 110433444 A * 11/2019

* cited by examiner

*Primary Examiner* — Matthew R Diaz

(57) ABSTRACT

The present invention discloses a foam material for fire prevention and extinguishing and a preparation method and a use thereof. The foam material for fire prevention and extinguishing comprises the following raw materials in parts by weight: 2-4 parts of foaming agent, 2.5-3.5 parts of foam stabilizer, 10-16 parts of expandable graphite, and 100 parts of water. The foam material for fire prevention and extinguishing has a foaming multiple up to 15-30 times, a viscosity of only 700 mPa·s at a flow state, and the foam could be stable for more than 12 h. After being transported to an ignition point of the goaf via the mine grouting pipeline, the foam material for fire prevention and extinguishing can spread and pile in a large area in the goaf, and thus cover and plug the float coal at low and high places, with a piling height above 1.5 m.

9 Claims, No Drawings

FOAM MATERIAL FOR FIRE PREVENTION AND EXTINGUISHING AND A PREPARATION METHOD AND A USE THEREOF

CROSS REFERENCE TO RELATED APPLICATION

This application claims the priority of Chinese Patent Application No. CN201911152736.X, entitled "Foam material for fire prevention and extinguishing and a preparation method and a use thereof" filed with the China National Intellectual Property Administration on Nov. 22, 2019, which is incorporated herein by reference in its entirety.

TECHNICAL FIELD

The present disclosure relates to materials for fire extinguishing in a coal mine, and in particular to a foam material for fire prevention and extinguishing and a preparation method and a use thereof.

BACKGROUND

The coal spontaneous combustion is one of the main natural disasters in coal mine production. According to statistics, more than 51.3% of key mines ran a risk of spontaneous combustion, and fire accidents caused by the coal spontaneous combustion accounted for more than 90% of the total fire accidents, wherein the fire accidents caused by the coal spontaneous combustion in the goaf accounted for 60% of the fire accidents caused by the spontaneous combustion. In recent years, with the vigorous popularization and application of fully mechanized sublevel caving, the yield of coal and the production benefit have been increased substantially. However, such coal mining method accompanies with a high mining strength, a high cave-in height, more residual coal in the goaf, and serious air leakage, and those problems result in more frequent spontaneous combustion of the residual coal in the goaf.

In order to prevent coal spontaneous combustion, the methods such as grouting, injecting an inert gas, injecting a gel and spraying an inhibitor have been used to prevent coal spontaneous combustion since the 1950s. Although these methods have positive effects on the prevention of coal spontaneous combustion in the goaf, they all have defects. For grouting, the slurry only flow along the lower terrain, and cannot cover the coal located in the medium-level and high-level terrains uniformly. For injecting an inert gas, the gas is easy to diffuse with the air leakage, and the ability of extinguishing fire and cooling for this method are also low. For injecting a gel, it has the defects of a high cost, a low flow rate and a limited diffusion area. For spraying an inhibitor, the inhibitor is difficult to uniformly disperse in the coal, and could corrode underground equipments easily. In order to avoid the problems caused by the above methods, the existing technology usually uses the method of injecting a foam to prevent the coal spontaneous combustion. The foam used in the method of injecting foam can spread to a large area, and pile to high places, thereby covering the coal located in the medium-level and high-level terrains uniformly. Furthermore, the foam is non-toxic and harmless to the environment. However, the foam materials used in the existing methods for injecting a foam had a poor stability, a lower foaming multiple, and a smaller piling height, and generally burst within 8 to 12 hours, and therefore they cannot prevent spontaneous combustion of coal in a lasting and effective manner.

Therefore, it is of great significance to develop a material for fire prevention and extinguishing with a high foaming multiple and a large piling height.

SUMMARY

It is an object of the present disclosure to provide a foam material for fire prevention and extinguishing and a preparation method and a use thereof. The foam material for fire prevention and extinguishing has a high foam stability, a high foam multiple, and a high piling height, and thus can prevent the spontaneous combustion of coal in the goaf.

In order to achieve the above object, the present disclosure provides the following technical solutions.

The present disclosure provides a foam material for fire prevention and extinguishing, comprising the following raw materials in parts by weight:

2-4 parts of foaming agent, 2.5-3.5 parts of foam stabilizer, 10-16 parts of expandable graphite, and 100 parts of water.

In some embodiments, the foam stabilizer is sodium alginate or carboxymethylcellulose sodium.

In some embodiments, the foam agent is a mixture of sodium α-olefin sulfonate and sodium dodecylbenzene sulfonate, or a mixture of sodium α-olefin sulfonate and sodium dodecyl sulfate.

In some embodiments, a mass ratio of the sodium α-olefin sulfonate to sodium dodecylbenzene sulfonate in the mixture of sodium α-olefin sulfonate and sodium dodecylbenzene sulfonate is 1:1; a mass ratio of sodium α-olefin sulfonate to sodium dodecyl sulfate in the mixture of sodium α-olefin sulfonate and sodium dodecyl sulfate is 1:1.

In some embodiments, the expandable graphite has a particle size of not more than 300 μm, and an expansion multiple of not less than 300 mL/g.

The present disclosure further provides a method for preparing the foam material for fire prevention and extinguishing as described above, comprising the following steps:

mixing a foam stabilizer, an expandable graphite with a part of water, and performing a first stirring to obtain a thickened solution;

mixing a foaming agent with the remaining water, and performing a second stirring to obtain a foam system; and mixing the thickened solution with the foam system, and performing a third stirring to obtain a foam material for fire prevention and extinguishing.

In some embodiments, the first stirring is performed at a stirring rate of 900-1100 r/min for 3-5 min.

In some embodiments, the second stirring is performed at a stirring rate of 1900-2100 r/min for 5-10 min.

In some embodiments, the third stirring is performed at a stirring rate of 1900-2100 r/min for 5-10 min.

The present disclosure further provides a use of the foam material for fire prevention and extinguishing as described above in the prevention of coal spontaneous combustion in the goaf.

The present disclosure provides a foam material for fire prevention and extinguishing, comprising the following raw materials in parts by weight: 2-4 parts of foaming agent, 2.5-3.5 parts of foam stabilizer, 10-16 parts of expandable graphite, and 100 parts of water.

In the present disclosure, the expandable graphite is used in the foam material for fire prevention and extinguishing, with the property that it could expand and generate a non-combustible gas when heated, thereby significantly enhancing the heat insulation and flame retardant effect of the foam material. With a combined function of the foaming agent and the foam stabilizer, the present disclosure improves the foaming multiple of the foam material for fire prevention and extinguishing and the stability of the foam, wherein the foam stabilizer which contains a large amount of —$COO^-$ can exhibit a behavior of the polyanion in an aqueous solution, and has a certain adhesion, and thus can reduce the discharge rate of the foam liquid film. At the same time, the expandable graphite, which is adsorbed in the Plateau region between the bubbles or dispersed in a continuous phase, increases viscosity of the system. The increase in viscosity enhances the strength of the liquid film and also reduces the discharge rate of the liquid film, thereby significantly enhancing the foam stability. The present disclosure reasonably controls the amount of each component, so that a synergistic effect is produced between the foaming agent, the foam stabilizer and the expandable graphite, thereby enhancing fire prevention and extinguishing effect of the foam material for fire prevention and extinguishing.

The present disclosure provides a method for preparing the foam material for fire prevention and extinguishing. The method according to the present disclosure is simple for operation and has lower requirements for process conditions and equipments, and thus is beneficial to industrial production.

The present disclosure provides a use of the foam material for fire prevention and extinguishing in the prevention of coal spontaneous combustion in the goaf. After being transported to an ignition point of the goaf via the grouting pipeline in the mine, the foam material for fire prevention and extinguishing can cover a large area of the float coal in the goaf and plug the coal cracks, wherein the expandable graphite expands when heated to form an expanded graphite material covering the surface of the coal and rock mass or plugging in the cracks of the coal and rock mass, thereby isolating the heat radiation and the contact with oxygen. At the same time, the expandable graphite generates a non-combustible gas when heated, which can dilute the oxygen in the goaf, significantly improving the effects of fire prevention, heat insulation and flame retardant. The result of examples shows that the foam material for fire prevention and extinguishing according to the present disclosure has a foaming multiple up to 15-30 times, indicating a good foaming performance; furthermore, it has a viscosity of only 700 mPa·s at a flow state, indicating a good flow diffusivity; the foam could be stable for more than 12 h, indicating a good foam stability. After being transported to the ignition point of the goaf via the grouting pipeline of the mine, the foam material for fire prevention and extinguishing can spread and pile in a large area in the goaf, and thus covers and plugs the float coal at low and high places, with a piling height above 1.5 m.

DETAILED DESCRIPTION OF THE EMBODIMENTS

The present disclosure provides a foam material for fire prevention and extinguishing, comprising the following raw materials in parts by weight:

2-4 parts of foaming agent, 2.5-3.5 parts of foam stabilizer, 10-16 parts of expandable graphite, and 100 parts of water.

According to the present disclosure, unless otherwise specified, the raw materials required are all commercially available products well known to those skilled in the art.

In parts by weight, the raw materials of the foam material for fire prevention and extinguishing according to the present disclosure comprises 100 parts of water. In the present disclosure, there is no particular limitation to the source of the water, and water well known to those skilled in the art may be used.

Relative to the weight part of water, the raw materials of the foam material for fire prevention and extinguishing according to the present disclosure comprises a foaming agent in an amount of 2-4 parts, preferably 2.5-3.5 parts, and more preferably 3 parts. In some embodiments, the foam agent is a mixture of sodium α-olefin sulfonate and sodium dodecylbenzene sulfonate, or a mixture of sodium α-olefin sulfonate and sodium dodecyl sulfate, and preferably a mixture of α-olefin sulfonate and sodium dodecylbenzene sulfonate. In some embodiments, a mass ratio of the sodium α-olefin sulfonate to sodium dodecylbenzene sulfonate in the mixture of sodium α-olefin sulfonate and sodium dodecylbenzene sulfonate is 1:1. In some embodiments, a mass ratio of sodium α-olefin sulfonate to sodium dodecyl sulfate in the mixture of sodium α-olefin sulfonate and sodium dodecyl sulfate is 1:1. The mixture of sodium α-olefin sulfonate and sodium dodecylbenzene sulfonate (or sodium dodecyl sulfate) is used as a foaming agent in the present disclosure and achieves a high foaming multiple and a good foam stability.

Relative to the weight parts of water, the raw materials of the foam material for fire prevention and extinguishing according to the present disclosure comprises a foam stabilizer in an amount of 2.5-3.5 parts, and preferably 3 parts. In some embodiments, the foam stabilizer is sodium alginate or carboxymethylcellulose sodium. In the present disclosure, sodium alginate (or carboxymethylcellulose sodium) is used as a foam stabilizer, which facilitates increasing the viscosity of the slurry, increases the stickiness of the formed foam liquid film, and makes the expandable graphite particles adhere to the bubbles more easily, thereby improving the foam stability.

Relative to the weight parts of water, the raw materials of the foam material for fire prevention and extinguishing according to the present disclosure comprises an expandable graphite in an amount of 10-16 parts, preferably 12-14 parts, and more preferably 13 parts. In some embodiments, the expandable graphite has a particle size of not more than 300 μm, and preferably 100-300 μm. In some embodiments, the expandable graphite has an expansion multiple of not less than 300 mL/g, and preferably 350 mL/g.

In the present disclosure, the expandable graphite is used in the foam material for fire prevention and extinguishing. When the foam material covers the surface of high temperature coal and rock mass, or plugs the cracks of coal and rock mass, the expandable graphite could expand when heated, and its volume increases quickly, forming expanded graphite material covering the surface of coal and rock mass or plugging the cracks of coal and rock mass, thereby isolating the heat radiation and the contact with oxygen; meanwhile, the expandable graphite generates a non-combustible gas when heated, which can dilute the oxygen in the goaf, significantly improving the effects of fire prevention, heat insulation and flame retardant.

The present disclosure further provides a method for preparing the foam material for fire prevention and extinguishing as described above, comprising the following steps:

mixing a foam stabilizer, an expandable graphite with a part of water, and performing a first stirring to obtain a thickened solution;

mixing a foaming agent with the remaining water, and performing a second stirring to obtain a foam system; and mixing the thickened solution with the foam system, and performing a third stirring to obtain a foam material for fire prevention and extinguishing.

In the present disclosure, a foam stabilizer and an expandable graphite are mixed with a part of water, and then a first stirring is performed on the mixture to obtain a thickened solution. In some embodiments, the first stirring is performed at a stirring rate of 900-1100 r/min, and preferably 1000 r/min. In some embodiments, the first stirring is performed for 3-5 min, and preferably 4 min. In the thickened solution, the water becomes thickened by dissolving the foam stabilizer in water, while the expandable graphite is suspended in the thickened solution.

In the present disclosure, a foaming agent is mixed with the remaining water, and then a second stirring is performed on the mixture to obtain a foam system. In some embodiments, the second stirring is performed at a stirring rate of 1900-2100 r/min, and preferably 2000 r/min. In some embodiments, the second stirring is performed for 5-10 min, preferably for 6-8 min, and more preferably 7 min. In some embodiments, a mass ratio of the part of water to the remaining water is 3:7. In the present disclosure, there is no particular limitation to the order of the preparation of the foam system and the thickened solution.

After obtaining the thickened solution and the foam system, the thickened solution is mixed with the foam system, and then a third stirring is performed on the mixture to obtain a foam material for fire prevention and extinguishing. In some embodiments, the third stirring is performed at a stirring rate of 1900-2100 r/min, and preferably 2000 r/min. In some embodiments, the third stirring is performed for 5-10 min, preferably 6-8 min and more preferably 7 min. During the mixing, the thickened solution and the foam system are mixed at a high stirring rate to be uniform. The foam stabilizer, which is dissolved in water of the foam liquid film, increases the stickiness of the foam liquid film and the stability of the foam, and meanwhile makes the expandable graphite adhere to the bubbles easily, resulting in a uniform dispersion of the expandable graphite in the foam system.

According to the present disclosure, the above feeding sequence can achieve a uniform dispersion of the expandable graphite in the foam system. According to the present disclosure, the expandable graphite is firstly mixed with the foam stabilizer to make the expandable graphite uniformly distributed in the thickened solution containing the foam stabilizer. The thickened solution containing the expandable graphite is then mixed with the foam system, and fully stirred to uniformly distribute the expandable graphite in the foam system.

The present disclosure provides a use of the foam material for fire prevention and extinguishing as described above in the prevention of coal spontaneous combustion in the goaf. According to the present disclosure, there is no special limitation to the method of using the foam material for fire prevention and extinguishing in preventing coal spontaneous combustion in the goaf. It is possible to use any method well known to those skilled in the art.

The technical solutions in the present disclosure will be described clearly and completely in combination with the examples in the present disclosure. Obviously, the examples described are only a part of the examples of the present disclosure, and not all the examples. Based on the examples of the present disclosure, all other examples obtained by a person of ordinary skill in the art without creative efforts fall into the protection scope of the present disclosure.

Example 1

The raw materials for preparing the foam materials for prevention and extinguishing: 1 kg of sodium α-olefin sulfonate, 1 kg of sodium dodecylbenzene sulfonate, 2.5 kg of sodium alginate, 10 kg of expandable graphite, and 100 kg of water.

30 kg of water, 2.5 kg of sodium alginate, and 10 kg of expandable graphite were added into a container A, and the mixture was stirred at a stirring rate of 1000 r/min for 4 min, to obtain a thickened solution;

70 kg of water, 1 kg of sodium α-olefin sulfonate, and 1 kg of sodium dodecylbenzene sulfonate were added into a container B, and the mixture was stirred at a stirring rate of 2000 r/min for 5 min, to obtain a foam system;

the thickened solution was added into the foam system, and the resulting mixture was stirred at a stirring rate of 2000 r/min for 5 min, to obtain the foam material for fire prevention and extinguishing.

Example 2

The raw materials for preparing the foam materials for prevention and extinguishing: 1.5 kg of sodium α-olefin sulfonate, 1.5 kg of sodium dodecylbenzene sulfonate, 3 kg of sodium alginate, 13 kg of expandable graphite, and 100 kg of water.

30 kg of water, 3 kg of sodium alginate, and 13 kg of expandable graphite were added into a container A, and the mixture was stirred at a stirring rate of 1000 r/min for 4 min, to obtain a thickened solution;

70 kg of water, 1.5 kg of sodium α-olefin sulfonate, and 1.5 kg of sodium dodecylbenzene sulfonate were added into a container B, and the mixture was stirred at a stirring rate of 2000 r/min for 8 min, to obtain a foam system;

the thickened solution was added into the foam system, and the resulting mixture was stirred at a stirring rate of 2000 r/min for 8 min, to obtain the foam material for fire prevention and extinguishing.

Example 3

The raw materials for preparing the foam materials for prevention and extinguishing: 2 kg of sodium α-olefin sulfonate, 2 kg of sodium dodecylbenzene sulfonate, 3.5 kg of sodium alginate, 16 kg of expandable graphite, and 100 kg of water.

30 kg of water, 3.5 kg of sodium alginate, and 16 kg of expandable graphite were added into a container A, and the mixture was stirred at a stirring rate of 1000 r/min for 5 min, to obtain a thickened solution;

70 kg of water, 2 kg of sodium α-olefin sulfonate, and 2 kg of sodium dodecylbenzene sulfonate were added into a container B, and the mixture was stirred at a stirring rate of 2000 r/min for 10 min, to obtain a foam system;

the thickened solution was added into the foam system, and the resulting mixture was stirred at a stirring rate of 2000 r/min for 10 min, to obtain the foam material for fire prevention and extinguishing.

Example 4

The raw materials for preparing the foam materials for prevention and extinguishing: 2 kg of sodium α-olefin sulfonate, 2 kg of sodium dodecylbenzene sulfonate, 2.5 kg of sodium alginate, 10 kg of expandable graphite, and 100 kg of water.

30 kg of water, 2.5 kg of sodium alginate, and 10 kg of expandable graphite were added into a container A, and the mixture was stirred at a stirring rate of 1000 r/min for 5 min, to obtain a thickened solution;

70 kg of water, 2 kg of sodium α-olefin sulfonate, and 2 kg of sodium dodecylbenzene sulfonate were added into a container B, and the mixture was stirred at a stirring rate of 2000 r/min for 10 min, to obtain a foam system;

the thickened solution was added to the foam system, and the resulting mixture was stirred at a stirring rate of 2000 r/min for 10 min, to obtain the foam material for fire prevention and extinguishing.

Example 5

The raw materials for preparing the foam materials for prevention and extinguishing: 2 kg of sodium α-olefin sulfonate, 2 kg of sodium dodecyl sulfate, 3 kg of carboxymethylcellulose sodium, 10 kg of expandable graphite, and 100 kg of water.

30 kg of water, 3 kg of carboxymethylcellulose sodium and 10 kg of expandable graphite were added into a container A, and the mixture was stirred at a stirring rate of 1000 r/min for 5 min, to obtain a thickened solution;

70 kg of water, 2 kg of sodium α-olefin sulfonate and 2 kg of sodium dodecyl sulfate were added into a container B, and the mixture was stirred at a stirring rate of 2000 r/min for 10 min, to obtain a foam system;

the thickened solution was added to the foam system, and the resulting mixture was stirred at a stirring rate of 2000 r/min for 10 min to obtain the foam material for fire prevention and extinguishing.

Comparative Example 1

The raw materials for preparing the foam materials for prevention and extinguishing: 1 kg of sodium α-olefin sulfonate, 1 kg of sodium dodecylbenzene sulfonate, 25 kg of fly ash, and 100 kg of water.

30 kg of water and 10 kg of fly ash were added into a container A, and the mixture was stirred at a stirring rate of 1000 r/min for 4 min, to obtain a slurry of fly ash;

70 kg of water, 1 kg of sodium α-olefin sulfonate, and 1 kg of sodium dodecylbenzene sulfonate were added into a container B, and the mixture was stirred at a stirring rate of 2000 r/min for 5 min, to obtain a foam system;

the slurry of fly ash was added to the foam system, and the resulting mixture was stirred at a stirring rate of 2000 r/min for 5 min, to obtain the fly ash foam material for preventing coal spontaneous combustion in the goaf.

Performance Test

The performance of the foam materials for fire prevention and extinguishing obtained in Examples 1-4 and Comparative Example 1 was tested by using them to prevent the coal spontaneous combustion in the goaf, wherein the foaming multiple and the foam stability were tested according to the standard for class A foam extinguishing agent (GB27897-2001), the piling height was tested according to a routine laboratory method, and the viscosity was tested by a viscometer. The results were shown in table 1.

Table 1 the performance data of the foam materials for fire prevention and extinguishing obtained in Examples 1-4 and Comparative Example 1

| Examples No. | Foaming multiple (time) | Piling height (m) | Viscosity at a flow state (mPa · s) | Stable time (h) |
|---|---|---|---|---|
| Example 1 | 15 | 1.5 | 575 | >12 |
| Example 2 | 20 | 1.7 | 641 | >12 |
| Example 3 | 26 | 1.8 | 673 | >12 |
| Example 4 | 30 | 1.9 | 700 | >12 |
| Example 5 | 30 | 1.9 | 700 | >12 |
| Comparative Example 1 | 13 | 1.2 | 550 | <8 |

It can be seen from table 1 that the foam material for fire prevention and extinguishing obtained in Comparative Example 1, in which the expandable graphite was not added, has a lower foaming multiple and a lower piling height, while the foam material for fire prevention and extinguishing provided by the present disclosure has a foaming multiple up to 15-30 times, indicating a good foaming performance; furthermore, it has a viscosity of only 700 mPa·s at a flow state, indicating a good flow diffusivity; and the foam could be stable for more than 12 h. After being transported to an ignition point of the goaf via the mine grouting pipeline, the foam material for fire prevention and extinguishing can spread and pile in a large area in the goaf, and thus cover and plug the float coal at low and high places, with a piling height above 1.5 m.

It can be seen from the above examples that the present disclosure provides a foam material for fire prevention and extinguishing and a preparation method and a use thereof. The foam material for fire prevention and extinguishing according to the present disclosure has a foaming multiple up to 15-30 times, indicating a good foaming performance; furthermore, it has a viscosity of only 700 mPa·s at a flow state, indicating a good flow diffusivity; and the foam could be stable for more than 12 h, indicating a good foam stability. After being transported to an ignition point of the goaf via the mine grouting pipeline, the foam material for fire prevention and extinguishing can spread and pile in a large area in the goaf, and thus cover and plug the float coal at low and high places, with a piling height above 1.5 m.

The above examples are only optional embodiments of the present disclosure. It should be pointed out that for those of ordinary skill in the art, some improvements and retouches can be made without departing from the principles of the present disclosure. These improvements and retouches also should be regarded as the protection scope of the present disclosure.

What is claimed is:

1. A foam material for fire prevention and extinguishing, comprising the following raw materials in parts by weight:

2-4 parts of foaming agent, 2.5-3.5 parts of foam stabilizer, 10-16 parts of expandable graphite, and 100 parts of water; wherein the expandable graphite is used for generating a non-combustible gas, increasing a viscosity of the foam material, and enhancing a foam stability;

the foam stabilizer is sodium alginate;

the foaming agent is a mixture of sodium α-olefin sulfonate and sodium dodecylbenzene sulfonate.

2. The foam material for fire prevention and extinguishing as claimed in claim 1, wherein a mass ratio of the sodium α-olefin sulfonate to sodium dodecylbenzene sulfonate in the mixture of sodium α-olefin sulfonate and sodium dodecylbenzene sulfonate is 1:1.

3. The foam material for fire prevention and extinguishing as claimed in claim 1, wherein the expandable graphite has a particle size of not more than 300 μm, and an expansion multiple of not less than 300 mL/g.

4. A method for preparing the foam material for fire prevention and extinguishing as claimed in claim 1, comprising the following steps:

mixing a foam stabilizer, an expandable graphite with a part of water, and performing a first stirring to obtain a thickened solution;

mixing a foaming agent with the remaining water, and performing a second stirring to obtain a foam system; and mixing the thickened solution with the foam system, and performing a third stirring to obtain a foam material for fire prevention and extinguishing; wherein the expandable graphite is used for generating a non-combustible gas, increasing a viscosity of the foam material, and enhancing a foam stability;

the foam stabilizer is sodium alginate;

the foaming agent is a mixture of sodium α-olefin sulfonate and sodium dodecylbenzene sulfonate.

5. The method as claimed in claim 4, wherein the first stirring is performed at a stirring rate of 900-1100 r/min for 3-5 min.

6. The method as claimed in claim 4, wherein the second stirring is performed at a stirring rate of 1900-2100 r/min for 5-10 min.

7. The method as claimed in claim 4, wherein the third stirring is performed at a stirring rate of 1900-2100 r/min for 5-10 min.

8. The method as claimed in claim 4, wherein a mass ratio of the sodium α-olefin sulfonate to sodium dodecylbenzene sulfonate in the mixture of sodium α-olefin sulfonate and sodium dodecylbenzene sulfonate is 1:1.

9. The method as claimed in claim 4, wherein the expandable graphite has a particle size of not more than 300 μm, and an expansion multiple of not less than 300 mL/g.

* * * * *